US006007644A

United States Patent [19]

Ohmori et al.

[11] Patent Number: 6,007,644

[45] Date of Patent: Dec. 28, 1999

[54] HEAVY-WALL H-SHAPED STEEL HAVING HIGH TOUGHNESS AND YIELD STRENGTH AND PROCESS FOR MAKING STEEL

[75] Inventors: Akio Ohmori; Tatsumi Kimura; Fumimaru Kawabata; Keniti Amano, all of Kurashiki, Japan

[73] Assignee: Kawasaki Steel Corporation, Hyogo, Japan

[21] Appl. No.: 09/257,185

[22] Filed: Feb. 25, 1999

[30] Foreign Application Priority Data

Mar. 5, 1998 [JP] Japan ..... 10-053984

[51] Int. Cl.[6] ..... C22C 38/04; C22C 38/06; C22C 38/12; C21D 7/13

[52] U.S. Cl. ..... 148/320; 148/332; 148/333; 148/334; 148/336; 148/654

[58] Field of Search ..... 148/320, 332, 148/333–336, 654; 420/127, 128, 104–105, 108, 112, 119

[56] References Cited

U.S. PATENT DOCUMENTS 4,397,697 8/1983 Freier et al. ..... 148/320

FOREIGN PATENT DOCUMENTS 53-57116 5/1978 Japan ..... 148/332
53-66818 6/1978 Japan ..... 148/332
56-35734 8/1981 Japan .
58-10422 2/1983 Japan .
4-210449 7/1992 Japan .
4-293716 10/1992 Japan .
5-132716 5/1993 Japan .
5-186848 7/1993 Japan .
9-125140 5/1997 Japan .
469764 8/1975 U.S.S.R. .
605854 5/1978 U.S.S.R. .

*Primary Examiner*—Deborah Yee
*Attorney, Agent, or Firm*—Oliff & Berridge, PLC

[57] ABSTRACT

A high-strength heavy-wall H-shaped steel is excellent in Z-direction toughness at the flange thickness center. The heavy-wall H-shaped steel is comprised of by weight from about 0.05 to 0.18% C, up to about 0.60% Si, from about 1.00% to about 1.80% Mn, up to about 0.020% P, under 0.004% S, from 0.016% to 0.050% Al, from 0.04% to 0.15% V, and from 0.0070% to 0.0200% N, and one or more of from about 0.02% to about 0.60% Cu, from about 0.02% to about 0.60% Ni, from about 0.02% to about 0.50% Cr, and from about 0.01% to about 0.20% Mo; and the balance being Fe and incidental impurities. Also, $(V \times N)/S \geqq 0.150$; the Ti content is within a range satisfying $0.002 \leqq Ti \leqq 1.38 \times N - 8.59 \times 10^{-4}$; Ceq (=C+Si/24+Mn/6+Ni/40+Cr/5+Mo/4+V/14) is within a range of from about 0.36 wt % to about 0.45 wt %, and the yield strength is at least 325 MPa.

20 Claims, 1 Drawing Sheet

FIGURE
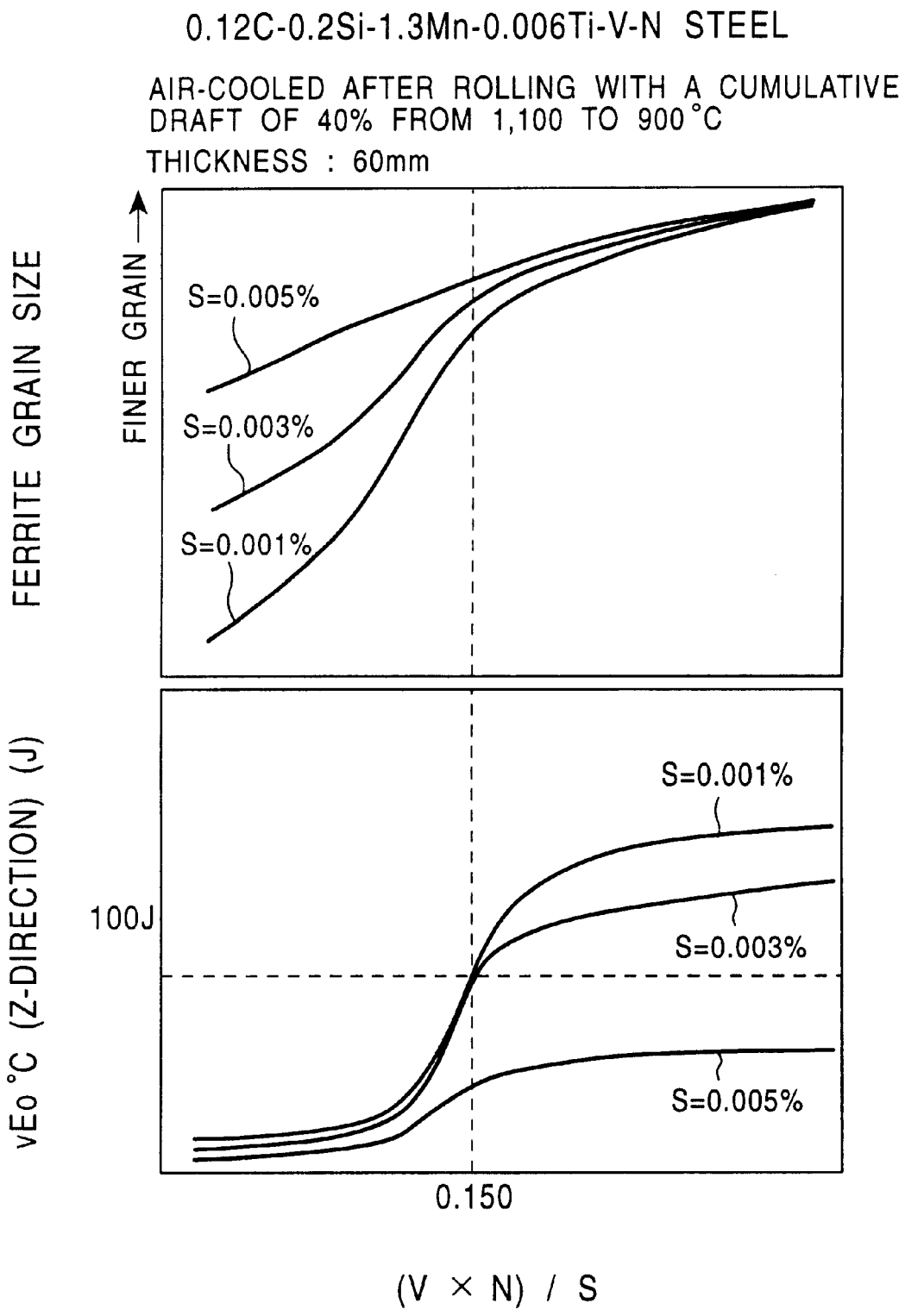

HEAVY-WALL H-SHAPED STEEL HAVING HIGH TOUGHNESS AND YIELD STRENGTH AND PROCESS FOR MAKING STEEL

BACKGROUND OF THE INVENTION

1. Field of Invention

The present invention relates to a heavy-wall H-shaped steel excellent in toughness and yield strength (abbreviated as "YS", yield point or proof stress) which is suitable for use in structural members such as pillars, beams and the like for a high-rise building. The present invention further relates to a process of making the steel.

In the present invention, the term "wt %" regarding the chemical composition means weight percentage. Herein, the "L-direction" means the rolling direction; the "C-direction" is a direction perpendicular to the rolling direction and the thickness direction; and the "Z-direction" is the thickness direction.

2. Description of Related Art

Hot-rolled H-shaped steels are popularly used for pillars and beams for buildings. For an H-shaped steel, SM490 steel, SM520 steel or SM570 steel (specified in JIS G 3106 as a rolled steel product for welded structure) are widely used. H-shaped steels are directed toward a larger thickness and a higher strength, along with the tendency of building toward greater heights and larger scales. For example, an H-shaped steel is required to have a YS of at least 325 MPa, or more preferably, at least 355 MPa, a yield ratio (YR) of up to 80%, and a high toughness. These properties are expressed by the following formula:

$$\text{Yield ratio(YR)}=\text{Yield strength(YS)}/\text{tensile strength(TS)}$$

However, an increase in thickness of a steel product generally tends to also lead to a decrease in its strength. In an H-shaped steel having a flange thickness of at least 40 mm, it is difficult to achieve a high strength as represented by a YS of at least 325 MPa or 355 MPa. In order to ensure a high strength by manufacturing the product based on an ordinary hot rolling process, it is inevitable to increase the carbon equivalent (Ceq) of the steel product, thus resulting in a higher welding crack sensitivity (degradation) and a decrease in toughness at the welding heat affected zone (hereinafter referred to as "welding HAZ").

In rolling a heavy-wall H-shaped steel, which must be carried out under an equipment limitation of a small mill load relative to the sectional area of the bloom, it is the usual practice to adopt a small reduction rolling (reduction/pass: 1 to 10%) at a high temperature (at least 950° C.) of a small deformation resistance. Under these rolling conditions, however, grain refinement is insufficient, leading to the problem of difficulty in obtaining a satisfactory toughness.

Manufacture based on the TMCP (Thermomechanical Control Process) is known to ensure satisfactory strength, toughness and weldability in heavy-wall H-shaped steel. For example, Japanese Examined Patent Publication No. 56-35734 discloses a manufacturing method of a flange-reinforced H-shaped steel, that includes the steps of hot-rolling a bloom into an H-shaped steel, rapidly cooling the resultant H-shaped steel from the flange outer surface to a temperature range of from the $Ar_1$ transformation point to the Ms transformation point, and then air-cooling the steel, thereby forming a fine, low-temperature-transformed microstructure. Japanese Examined Patent Publication No. 58-10422 discloses a manufacturing method of a high-strength steel excellent in workability that includes the steps of, after heating, applying a rolling reduction of at least 30% at a temperature at least within the range of from 980° C. to the $Ar_3$ transformation point to cause precipitation of ferrite, and rapidly cooling such that the resultant steel has a ferrite-martensite dual-phase composite microstructure.

In these conventional techniques, however, rapid cooling from the flange outer surface after hot rolling results in considerable differences in strength and toughness on the flange thickness cross-section and in serious levels of residual stress and strain, thus posing many problems upon application to a heavy-wall H-shaped steel.

Japanese Unexamined Patent Publication No. 9-125140 discloses that a certain S content (0.004 to 0.015 wt %) and addition of V and N enables a ferrite refinement effect of VN precipitating during rolling and subsequent cooling, thus giving a heavy-wall H-shaped steel having excellent properties. This publication also discloses that an appropriate combination of rolling conditions in the recrystallization region brings about a further improvement of the refinement effect. In this technique, however, it is necessary to use an S content of at least 0.004 wt % in addition to V and N to achieve the ferrite refinement effect, and as a result, improvement of toughness is limited at least to some extent by production of MnS. A particularly serious problem in such steels is a still insufficient Charpy absorbed energy in the Z-direction.

Japanese Unexamined Patent Publication No. 5-132716 discloses a toughness improvement technique by grain refinement. The grain refinement is achieved by creating inner-grain ferrite by dispersing composite inclusions composed of Al, Ti, Mn or Si composite oxides, MnS and VN. In this technique, however, it is sometimes difficult to disperse oxide particles finely and uniformly. Consequently, the grain refinement is sometimes insufficient. Accordingly, it is difficult to improve toughness in the Z-direction.

When a bending strain is applied to a beam of a building structure by an earthquake or a like high-energy event, stress concentrates in the Z-direction at a junction of a pillar and the beam. With a small Charpy absorbed energy in the Z-direction, such stress concentration causes brittle fracture even from a small deformation. For the purpose of improving seismic resistance, therefore, the Charpy absorbed energy in the Z-direction should preferably be as high as possible.

SUMMARY OF THE INVENTION

The present invention has therefore an object to provide a high-strength and high-toughness heavy wall, H-shaped steel.

According to embodiments of this invention, the heavy wall, H-shaped steel is excellent in toughness in the Z-direction at the flange thickness center.

Another object of the present invention is to provide a process for making the heavy-wall H-shaped steel.

In order to achieve the aforementioned object, it is important to reduce the S content and to add Al, V, N and Ti in appropriate amounts. In the conventional materials, the amount of precipitated VN is decreased as the S content is decreased, so that it has been impossible to achieve a full microstructure refinement effect of VN. Based on this fact, the present inventors carried out various experiments and studies with respect to achieving a microstructure refining effect by VN even when reducing the S content, and achieved the following findings:

(1) Austenite grain refinement increases the grain boundary area which is a precipitation site of VN, and accelerates precipitation of VN effective for microstructure refinement. Austenite grain refinement is accomplished by addition of Ti in an appropriate amount and rolling in the recrystallization region.

(2) TiN dispersed in the steel serves as a precipitation site of VN, thereby accelerating precipitation of VN. The effect of accelerating precipitation of VN is particularly remarkable for fine TiN having a grain size of up to about 50 nm. The effect is less remarkable for coarse TiN having a grain size of above about 100 nm. It is therefore desirable to have an average TiN grain size of up to about 50 nm, and to distribute as many as fine TiN grains as possible.

(3) Adding Al in appropriate amounts is effective to many fine TiN grains.

(4) The above-mentioned effects (1), (2) and (3) are achieved by keeping an appropriate balance of the amounts of added V, N, S, Ti and Al thus giving a heavy-wall H-shaped steel satisfactory in strength, toughness, weldability and seismic resistance.

The present invention was developed on the basis of the findings as described above, and the heavy-wall H-shaped steel according to embodiments of the invention excellent in toughness at the flange thickness center and having a yield strength of at least about 325 Mpa has a composition comprising:

C: from about 0.05 to about 0.15 wt %,

Si: up to about 0.60 wt %,

Mn: from about 1.00 to about 1.80 wt %,

P: up to about 0.020 wt %,

S: less than 0.04 wt %,

Al: from 0.016 to 0.050 wt %,

V: from 0.04 to 0.15 wt %,

N: from 0.0070 to 0.0200 wt %, and further comprising one or more elements selected from:

Cu: from about 0.020 to about 0.60 wt %,

Ni: from about 0.02 to about 0.60 wt %,

Cr: from about 0.02 to about 0.50 wt %,

Mo: from about 0.01 to about 0.20 wt %, and the balance being Fe and incidental impurities.

Also, the V content and the N content are within ranges satisfying the following formula (1); the Ti content is within a range satisfying the following formula (2); and the carbon equivalent (Ceq) as defined by the following formula (3) is within a range of from about 0.36 wt % to about 0.45 wt %:

$$(V \times N)/S \geq 0.150 \quad (1)$$

$$0.002 \leq Ti \leq 1.38 \times N - 8.59 \times 10^{-4} \quad (2)$$

$$Ceq = C + Si/24 + Mn/6 + Ni/40 + Cr/5 + Mo/4 + V/14 \quad (3)$$

In the present invention, the steel may comprise one or two of from about 0.0010 to about 0.0200 wt % REM and from about 0.0005 to about 0.0100 wt % Ca and/or from about 0.0001 to about 0.0020 wt % B. "REM" represents rare earth metals. REM are lanthanide element metals, such as La, Ce, Pr and so on.

BRIEF DESCRIPTION OF THE DRAWINGS

The drawing FIGURE is a graph illustrating relationships between Charpy 15 absorbed energy $vE_o$ in the Z-direction and ferrite grain size versus (V×N)/S achieved by changing the V or N content at a constant S content in the steel.

DETAILED DESCRIPTION OF PREFERRED EMBODIMENTS

The heavy-wall H-shaped steel according to embodiments of the present invention has properties including a yield strength (YS) at the flange thickness center of at least about 325 MPa, a yield ratio (YR) of up to about 80%, and a Charpy absorbed energy at 0° C. ($vE_0$) of at least about 100 J.

A YS of less than about 325 MPa results in a strength insufficient for use as a pillar material, and a YR of about 80% results in a problem of a lower seismic resistance. A $vE_0$ value of less than about 100 J relates to a tendency of easy occurrence of brittle fracture.

The reasons for selecting the chemical composition of the heavy-wall H-shaped steel of the invention will now be described.

C: from about 0.05 to about 0.18 wt %

For a higher strength, C should be at least about 0.05 wt %. A C content of above about 0.18 wt %, however, results in a decrease in toughness and weldability of the base metal. The C content should therefore be within a range of from about 0.05 to about 0.18 wt %, and preferably, from about 0.08 to about 0.16 wt %.

Si: up to about 0.60 wt %

While Si is an element effective for increasing strength, a Si content of above about 0.60 wt % corresponds to a serious decrease in the toughness of a weld heat affected zone (hereinafter referred to as "HAZ toughness"). The Si content should therefore be limited to up to about 0.60 wt %. A Si content of less than about 0.10 wt % gives only a slight effect of increasing strength. The Si content should therefore preferably be within a range of from about 0.10 to about 0.60 wt %.

Mn: from about 1.00 to about 1.80 wt %

Mn is an element that is effective for achieving a higher strength. A lower limit of about 1.00 wt % is desired to ensure a satisfactory strength. With an Mn content of above about 1.80 wt %, however, the microstructure air-cooled after rolling transforms from ferrite+pearlite to ferrite+bainite, resulting in a poorer toughness. An upper limit of about 1.80 wt % is provided. The preferred range of the Mn content is from about 1.20 to about 1.70 wt %.

P: up to about 0.020 wt %

The P content should be reduced to a content as small as possible because P causes a decrease in toughness of the base metal, HAZ toughness and welding crack resistance. An upper limit of about 0.020 wt % is therefore preferred in this invention.

S: less than 0.004 wt %

S has a function of accelerating precipitation of VN and refining the microstructure, but also causes a decrease in ductility and toughness through formation of MnS. Particularly, with an S content of above 0.004 wt %, MnS elongated by rolling leads to a serious decrease in toughness in the C and Z-directions. The S content should therefore be limited to less than 0.004 wt %. An S addition of less than or equal to 0.001 wt % is preferred in this invention.

Al: from 0.016 to 0.050 wt %

Al is effective for deoxidation purposes. However, if the Al addition is less than 0.016 wt %, the deoxidation effect is insufficient and Ti oxide is produced. Consequently, the Ti addition effect, which is described below, becomes insufficient. Also, because an Al content of above 0.050 wt % only leads to saturation of the deoxidizing effect and provides substantially no additional deoxidizing effect, an upper limit of 0.050 wt % is preferred.

V: from 0.04 to 0.15 wt %

V precipitates in the form of VN in austenite during rolling or during cooling after rolling, serves as a ferrite nucleation site, and refines the crystal grains. V plays an important role of increasing strength of the base metal through the intensification of precipitation, and is indispensable for ensuring satisfactory strength and toughness of the base metal. In order to achieve these effects, the V content should be at least 0.04 wt %. A V content of above 0.15 wt % leads, however, to serious deterioration of toughness and weldability of the base metal. The V content is therefore limited within a range of from 0.04 to 0.15 wt %, and is preferably from 0.05 to 0.12 wt %.

N: from 0.0070 to 0.0200 wt %

N, when combined with V, improves strength and toughness of the base metal in the form of VN. To achieve these effects, the N content should be at least 0.0070 wt %. With an N content of above 0.0200 wt %, toughness and weldability of the base metal are seriously reduced. The N content should therefore be limited within a range of from 0.0070 to 0.0200 wt %, and preferably, from 0.0070 to 0.0160 wt %.

One or more of: Cu: from about 0.020 to about 0.60 wt %: Ni: from about 0.02 to about 0.60 wt %: Cr: from about 0.02 to about 0.50 wt %: and Mo: from about 0.01 to about 0.20 wt %

Cu, Ni, Cr and Mo are all elements effective for improving hardenability, and are therefore added for increasing strength. For this purpose, the amounts of Cu, Ni, Cr and Mo should be at least about 0.02 wt %, at least about 0.02 wt %, at least about 0.02 wt % and at least about 0.01 wt %, respectively. To compensate deterioration of hot-workability caused by Cu, it is desirable to add Ni simultaneously. For the purpose of compensating the decrease in hot workability due to Cu, the Ni content should be substantially equal to the Cu content. However, because a Ni content of above about 0.60 wt % results in a very high cost, upper limits of Cu and Ni of about 0.60 wt % are preferred. Cr and Mo contents of above about 0.50 wt % and about 0.20 wt %, respectively, impair weldability and toughness. Accordingly, upper limits of about 0.50 wt % and about 0.20 wt % are therefore preferred for Cr and Mo, respectively.

$$(V \times N)/S \geqq 0.150 \quad (1)$$

In order to improve toughness in the Z-direction, it is necessary to adopt a larger value of V×N to increase the value amount of VN precipitation simultaneously with the above-mentioned reduction of S and the addition of Ti described below. As shown in the drawing FIGURE, when the S content is large or the value of V×N is small with a value of (V×N)/S of less than 0.150, the ferrite refining effect brought about by the increase in the amount of impurities such as MnS or by the precipitated VN is insufficient to obtain an excellent Z-direction toughness. A lower limit of (V×N)/S of 0.150 is therefore preferred.

The drawing FIGURE also shows the changes in the Z-direction Charpy absorbed energy (lower curve) and the ferrite grain size (upper curve) with various values of (V×N)/S obtained by changing the amount of added V or N at a constant S content. This graph suggests that, as (V×N)/S increases, the ferrite grain size becomes finer, and Z-direction toughness is improved. In the conventional materials having an S content of at least 0.004 wt %, while refinement of ferrite grains has been achieved, the Z-direction toughness has not been satisfactory. In this invention, ferrite refinement on a level of a high-S steel is achieved and simultaneously a Z-direction absorbed energy of at least about 100 J is obtained by adding Al and Ti in an appropriate amount and using a (V×N)/S value of at least 0.150 wt % to make full use of the aforementioned effects (1) to (4).

$$0.002 \leqq Ti \leqq 1.38 \times N - 8.59 \times 10^{-4} \quad (2)$$

Ti is finely dispersed as stable TiN even at a high temperature, inhibits austenite grain growth during heating before rolling, and refines ferrite grain size after rolling, thereby permitting achievement of high strength and toughness. With Ti, it is also possible to inhibit austenite grain growth even during welding heating, achieve. refinement even in the welding heat affected zone, and obtain an excellent HAZ toughness. Further in the present invention, Ti is an essential element for accelerating VN precipitation, and when reducing S having an effect of accelerating VN precipitation, indispensable for obtaining a fine grain microstructure through achievement of VN precipitation in a sufficient amount. In order to ensure full achievement of these effects, it is necessary to add Ti in an amount of at least about 0.002 wt %. With a Ti content of over ($1.38 \times N - 8.59 \times 10^{-4}$) wt %, however, an increase of coarse TiN grains reduces the effect of accelerating VN precipitation, and the N content in steel for forming VN becomes insufficient, thus making it impossible to obtain a sufficient fine grain microstructure. The Ti content should therefore be limited within a range satisfactory the formula (2).

Ceq: from about 0.36 to about 0.45 wt % as defined by the formula (3)

$$Ceq\ (wt\ \%) = C + Si/24 + Mn/6 + Ni/40 + Cr/5 + Mo/4 + V/14 \quad (3)$$

A value of the carbon equivalent (Ceq) of above about 0.45 wt % results in a decrease in welding crack sensitivity, and at the same time, to a decrease in HAZ toughness. A value of Ceq of less than about 0.36 wt %, on the other hand, makes it difficult to ensure a satisfactory strength in the base metal and in the HAZ softened part. By maintaining Ceq within this range, weldability of the steel is adjusted within the most appropriate range, and the ferrite nucleation function by VN can be more easily displayed. The value of Ceq should therefore preferably be within a range of from about 0.36 to about 0.45 wt %.

One or more of from about 0.0010 to about 0.0200 wt % REM and from about 0.0005 to about 0.0100 wt % Ca REM or Ca is finely dispersed as stable inclusions (oxide, sulfide) even at high temperatures, inhibits growth of austenite grains during heating before rolling, and refines ferrite grains after rolling, thus ensuring high strength and toughness. REM or Ca inhibits growth of austenite grains also during welding heating, can achieve refinement even in the welding HAZ, and gives an excellent HAZ toughness. In order to achieve these effects, the content of REM or Ca should be at least about 0.0010 wt % or about 0.0005 wt %, respectively. A content of above about 0.0200 wt % or about 0.0100 wt %, respectively, leads to a decrease in cleanliness and toughness of the steel. The amounts of added REM and Ca should therefore be within ranges of from about 0.0010 to about 0.0200 wt %, and from about 0.0005 to about 0.0100 wt %, respectively.

B: from about 0.0001 to about 0.0020 wt %

B is precipitated during rolling or subsequent cooling in the form of BN and refines ferrite grains after rolling, and this effect is available with a B content of at least about 0.0001 wt %. However, because a B content of above about 0.0020 wt % results in a decreased toughness, the B content is preferably limited within a range of from about 0.0001 to about 0.0020 wt %.

The heavy-wall H-shaped steel of the invention should preferably be manufactured by a process comprising the steps of heating the bloom having the aforementioned composition to a temperature of from about 1,050° C. to about 1,350° C., conducting rolling at a temperature within a range of from about 1,100° C. to about 950° C. under conditions including a reduction per pass of from about 5% to about 10% and a total reduction of at least about 20%, and then air-cooling the rolled steel to the room temperature or, after slow cooling—high temperature stoppage of cooling, air-cooling the steel. As a result, it is possible to convert the microstructure of the heavy-wall H-shaped steel into a ferrite+pearlite structure or to a ferrite-pearlite-bainite structure (ferrite area ratio: from about 50% to about 90%) and impart stably the properties as above described to the heavy-wall H-shaped steel.

The preferable rolling and cooling conditions are adopted for the following reasons:

Heating temperature: from about 1.050 to about 1,350° C.

At a heating temperature of hot rolling (rolling heating temperature) of less than about 1,050° C., the bloom has a high deformation resistance and a very high rolling load that makes it difficult to obtain a prescribed geometry. When heating to a temperature of about 1,350° C., on the other hand, grains of the bloom grow too much, and it is difficult to refine the grains even by subsequent rolling. The rolling heating temperature should therefore preferably be within a range of from about 1,050° C. to about 1,350° C.

Rolling temperature and reduction: a reduction per pass of from 5% to 10% and a total reduction of at least about 20% within a temperature range of from about 1.100 to about 950° C.

In order to achieve remarkable refinement, it is desirable to combine refinement by rolling in addition to the grain refining effect of VN. More specifically, within a temperature range of from about 1,100° C. to about 950° C., the flange is reduced with a reduction per pass of from about 5% to about 10% and a total reduction of at least about 20%. That is, recrystallization refinement is achieved by repeating reduction with a reduction per pass of from about 5% to 10% necessary for partial recrystallization, and applying an amount of fabrication as represented by a total reduction of at least 20%, and this also permits acceleration of VN precipitation. The largest possible reduction per pass would be desirable in terms of recrystallization refinement. This would lead, however, to the drawbacks of an increased deformation resistance and a decreased geometric accuracy. It is therefore desirable to use a small-reduction rolling range of from about 5% to about 10%. When any of the rolling temperature, the reduction per pass and the total reduction is out of the aforementioned range, the VN refinement is not completely satisfactory.

Cooling after rolling: air-cooling to room temperature, or air-cooling to room temperature after slow cooling—high temperature stoppage of cooling Cooling to the room temperature after rolling prevents dispersions in strength and toughness and the occurrence of distortion. When a high strength is to be obtained with a low Ceq, or when the flange thickness is large, the rolled steel may be cooled by water cooling or the like to pass through the high-temperature region after rolling at a higher cooling rate than by air cooling, and then may be air cooled at a lower cooling rate, as is known as "slow cooling—high temperature stoppage of cooling". This "slow cooling—high temperature stoppage of cooling" means a process of cooling carried out under conditions including a cooling rate of from about 0.2° C./s to 2.0° C./s and a cooling stoppage temperature of from about 700° C. to about 550° C. At a cooling rate of less than about 0.20° C./s, it is difficult to ensure a prescribed strength. At a cooling rate of above about 2.0° C./s, the microstructure become a bainite structure, thus leading to a lower toughness. The cooling rate in slow cooling should therefore preferably be within a range of from about 0.2° C./s to about 2.0° C./s. From the point of view of uniformity throughout the thickness, this range should more preferably be from about 0.2° C./s to 1.5° C./s. Further, a cooling stoppage temperature of above about 700° C. eliminates the effect of accelerated cooling, and a temperature of less than about 550° C. tends to result in a bainite microstructure with a lower toughness. The cooling stoppage temperature after slow cooling should therefore preferably be within a range of from about 700° C. to about 550° C.

EXAMPLES

Steels A to V having a chemical composition and Ceq value as shown in Table 1 were heated to a temperature of from 1,120° C. to 1,320° C., and rolled and cooled under various conditions as shown in Tables 2 to 5 to manufacture heavy-wall H-shaped steels having a flange thickness of from 60 to 100 mm. JIS No. 4 tensile test pieces and JIS No. 4 impact test pieces were sampled from each of the heavy-wall H-shaped steels at ¼ flange width or ¾ flange width, in L, C and Z directions from the flange thickness center (½t) and only in the L-direction from a position at a depth of 10 mm from the flange surface. These test pieces were tested for mechanical properties. The results are shown in Tables 2 to 5.

As is clear from the test results shown in Tables 2 to 5, the heavy-wall H-shaped steels having a Ceq value within the scope of the invention are more excellent in toughness in L, C and Z-directions, as represented by a vEo value of at least 100 J, and only a small difference in toughness between the L and C-directions. The examples of the invention demonstrated only a slight difference in strength between the surface portion and the thickness center, exhibited a high strength in YS of at least 325 MPa, and also a YR of up to 80%. Under rolling and cooling conditions within the aforementioned suitable ranges, particularly excellent strength and toughness were obtained.

Heavy-wall H-shaped steels L to V of the comparative examples having Ceq values, an N content, a V content, (V×N)/S values, Ti content, S content and Al content all outside the scope of the invention demonstrated a low vEo in general. Some of the comparative examples exhibited a high YR of over 80% and some other comparative examples showed only a poor strength. For example, the value of (V×N)/S was as low as less than 0.150 wt % in steel Q because of a high S content, in steel R because of a low V content, and in steel T because of a low N content, and with a low toughness in the C-direction and Z-direction in all of these examples. In steel N, in which the V, N and S contents were within the scope of the invention, the value of (V×N)/S was less than 0.150 wt %, structure refinement and reduction of inclusions were insufficient, and toughness in the C-direction and the Z-direction were not improved. In steel O, the effect of VN was not available because of the Ti content of above the upper limit defined by the formula (2), with a low strength and an unsatisfactory toughness in the Z-direction. In steel S, because of a low Al content, the effect of adding VN was insufficient, and toughness was not improved.

For the purpose of evaluating welding crack sensitivity, a y-type welding cracking test as specified in JIS Z 3158 was carried out. The test was carried out by cutting 50 mm thick×200 mm long×150 mm wide test pieces from the flanges of Steels A, D and H of the invention, and steels L and N of the comparative examples, using a covered electrode for high-strength steel under conditions including a welding current of 170 A, a welding voltage of 24 V, a welding speed of 150 mm/min, and a welding preheating temperature of 50 ° C. As a result, cracks were produced in steels L and N representing comparative examples, and no cracking occurred in steels A, D and H, representing examples of the invention.

TABLE 1

| Steel | C | Si | Mn | P | S | Al | Cu | Ni | Cr | Mo | V | N | B | Ti | Ca | REM | Ceq | (VxN)/S |
|---|---|---|---|---|---|---|---|---|---|---|---|---|---|---|---|---|---|---|
| Examples of the Invention | | | | | | | | | | | | | | | | | | |
| A | 0.12 | 0.35 | 1.31 | 0.011 | 0.003 | 0.025 | 0.35 | 0.35 | | | 0.064 | 0.0070 | | 0.006 | | | 0.366 | 0.152 |
| B | 0.10 | 0.42 | 1.42 | 0.012 | 0.002 | 0.026 | 0.21 | 0.21 | 0.12 | | 0.084 | 0.0098 | 0.0003 | 0.007 | | | 0.389 | 0.412 |
| C | 0.14 | 0.35 | 1.23 | 0.012 | 0.001 | 0.018 | 0.12 | | | | 0.071 | 0.0113 | | 0.008 | | | 0.365 | 0.802 |
| D | 0.16 | 0.25 | 1.03 | 0.011 | 0.002 | 0.030 | 0.29 | 0.29 | | 0.08 | 0.061 | 0.0088 | | 0.007 | | 0.0044 | 0.374 | 0.268 |
| E | 0.08 | 0.39 | 1.76 | 0.014 | 0.001 | 0.022 | | | 0.22 | | 0.056 | 0.0078 | | 0.005 | 0.0033 | | 0.438 | 0.437 |
| F | 0.12 | 0.44 | 1.41 | 0.015 | 0.001 | 0.028 | 0.45 | 0.40 | | | 0.061 | 0.0151 | | 0.017 | | | 0.388 | 0.921 |
| G | 0.14 | 0.34 | 1.43 | 0.013 | 0.002 | 0.034 | | | 0.24 | | 0.105 | 0.0080 | | 0.006 | | | 0.448 | 0.420 |
| H | 0.13 | 0.20 | 1.45 | 0.011 | 0.001 | 0.022 | | 0.21 | | | 0.063 | 0.0077 | | 0.006 | | | 0.390 | 0.485 |
| I | 0.16 | 0.24 | 1.35 | 0.020 | 0.002 | 0.028 | | | | 0.20 | 0.050 | 0.0086 | | 0.007 | | 0.0062 | 0.445 | 0.215 |
| J | 0.13 | 0.31 | 1.67 | 0.019 | 0.001 | 0.030 | | 0.15 | 0.10 | | 0.075 | 0.0120 | 0.0006 | 0.011 | 0.0050 | | 0.450 | 1.800 |
| K | 0.12 | 0.38 | 1.33 | 0.012 | 0.001 | 0.024 | 0.36 | 0.34 | | | 0.065 | 0.0074 | | 0.003 | | | 0.371 | 0.160 |
| Comparative Examples | | | | | | | | | | | | | | | | | | |
| L | 0.18 | 0.41 | 1.60 | 0.013 | 0.003 | 0.031 | 0.31 | 0.28 | | 0.08 | 0.063 | 0.0080 | | 0.007 | | | 0.495 | 0.168 |
| M | 0.10 | 0.40 | 1.45 | 0.011 | 0.001 | 0.016 | | 0.15 | | | 0.090 | 0.0208 | | 0.015 | | | 0.369 | 1.872 |
| N | 0.12 | 0.38 | 1.42 | 0.014 | 0.003 | 0.025 | 0.36 | 0.31 | 0.22 | | 0.050 | 0.0070 | | 0.005 | | | 0.428 | 0.142 |
| O | 0.13 | 0.38 | 1.48 | 0.015 | 0.001 | 0.033 | 0.28 | 0.30 | | | 0.064 | 0.0087 | | 0.015 | | | 0.405 | 0.557 |
| P | 0.12 | 0.45 | 1.35 | 0.015 | 0.005 | 0.030 | 0.22 | 0.15 | | | 0.066 | 0.0088 | | 0.006 | | | 0.372 | 0.166 |
| Q | 0.15 | 0.22 | 1.21 | 0.012 | 0.005 | 0.025 | 0.12 | 0.05 | | | 0.059 | 0.0082 | | 0.008 | | | 0.366 | 0.097 |
| R | 0.13 | 0.15 | 1.38 | 0.011 | 0.002 | 0.026 | 0.10 | 0.05 | | | 0.038 | 0.0077 | | 0.009 | | | 0.370 | 0.146 |
| S | 0.12 | 0.31 | 1.42 | 0.012 | 0.002 | 0.013 | | | | | 0.065 | 0.0090 | | 0.006 | | | 0.375 | 0.293 |
| T | 0.13 | 0.50 | 1.35 | 0.015 | 0.002 | 0.024 | | 0.11 | | | 0.050 | 0.0059 | | 0.007 | | | 0.382 | 0.148 |
| U | 0.12 | 0.34 | 1.42 | 0.011 | 0.003 | 0.023 | 0.13 | 0.10 | | | 0.068 | 0.0091 | | 0.001 | | | 0.378 | 0.206 |
| V | 0.14 | 0.35 | 1.54 | 0.012 | 0.004 | 0.025 | 0.16 | | | | 0.070 | 0.0111 | | 0.010 | | | 0.416 | 0.194 |

TABLE 2

| No. | Steel | Draft/pass (%) | Cumulative draft 1100–950° C. (%) | Flange thickness (mm) | Cooling after rolling | Site | Direction | Micro-structure* | Ferrite area ratio (%) | Grain size No. | YS (MPa) | TS (MPa) | YR (%) | $vE_o$ (J) | |
|---|---|---|---|---|---|---|---|---|---|---|---|---|---|---|---|
| A-1 | A | 5–9 | 45 | 60 | Air cooling | Surface | L | F + P | 79 | 7.5 | 424 | 585 | 72 | 305 | Examples of the Invention |
| | | | | | | 1/2t | L | F + P | 80 | 7 | 406 | 577 | 70 | 297 | |
| | | | | | | 1/2t | C | | | | 415 | 573 | 72 | 202 | |
| | | | | | | 1/2t | Z | | | | 400 | 553 | 72 | 106 | |
| A-2 | A | 6–10 | 20 | 80 | Air cooling | Surface | L | F + P | 79 | 7 | 394 | 562 | 70 | 272 | |
| | | | | | | 1/2t | L | F + P | 80 | 6.5 | 386 | 551 | 70 | 258 | |
| | | | | | | 1/2t | C | | | | 382 | 553 | 69 | 253 | |
| | | | | | | 1/2t | Z | | | | 370 | 535 | 69 | 110 | |
| A-3 | A | 5–9 | 30 | 100 | Air cooling | Surface | L | F + P | 78 | 7 | 383 | 549 | 70 | 286 | |
| | | | | | | 1/2t | L | F + P | 80 | 6.5 | 374 | 531 | 70 | 268 | |
| | | | | | | 1/2t | C | | | | 373 | 532 | 70 | 240 | |
| | | | | | | 1/2t | Z | | | | 362 | 515 | 70 | 108 | |
| A-4 | A | 6–9 | 30 | 100 | Water-cooled | Surface | L | F + P + B | 73 | 7.5 | 430 | 583 | 74 | 240 | |
| | | | | | at 0.8° C./s | 1/2t | L | F + P + B | 75 | 7 | 412 | 571 | 72 | 267 | |
| | | | | | from 940 to | 1/2t | C | | | | 411 | 568 | 72 | 253 | |
| | | | | | 600° C. | 1/2t | Z | | | | 403 | 545 | 74 | 111 | |
| B-1 | B | 5–8 | 25 | 80 | Air cooling | Surface | L | F + P | 81 | 7 | 414 | 577 | 72 | 312 | |
| | | | | | | 1/2t | L | F + P | 83 | 6.5 | 396 | 564 | 70 | 299 | |
| | | | | | | 1/2t | C | | | | 383 | 558 | 69 | 276 | |
| | | | | | | 1/2t | Z | | | | 372 | 535 | 70 | 121 | |
| C-1 | C | 4–8 | 30 | 70 | Air cooling | Surface | L | F + P | 77 | 7 | 415 | 595 | 70 | 265 | |
| | | | | | | 1/2t | L | F + P | 78 | 6.5 | 404 | 575 | 70 | 244 | |
| | | | | | | 1/2t | C | | | | 409 | 581 | 70 | 246 | |
| | | | | | | 1/2t | Z | | | | 400 | 568 | 70 | 135 | |

*Microstructure: F: ferrite; P: pearlite; B: bainite

TABLE 3

| No. | Steel | Draft/pass (%) | Cumulative draft 1100–950° C. (%) | Flange thickness (mm) | Cooling after rolling | Site | Direction | Micro-structure* | Ferrite area ratio (%) | Grain size No. | YS (MPa) | TS (MPa) | YR (%) | $vE_o$ (J) | |
|---|---|---|---|---|---|---|---|---|---|---|---|---|---|---|---|
| C-2 | C | 6–9 | 30 | 70 | Water-cooled | Surface | L | F + P + B | 73 | 7.5 | 487 | 606 | 80 | 232 | Examples of the Invention |
| | | | | | at 1.5° C./s | 1/2t | L | F + P + B | 75 | 7 | 468 | 585 | 80 | 224 | |
| | | | | | from 940 to | 1/2t | C | | | | 472 | 586 | 81 | 211 | |
| | | | | | 530° C. | 1/2t | Z | | | | 464 | 577 | 80 | 132 | |
| D-1 | D | 5–10 | 35 | 80 | Water-cooled | Surface | L | F + P | 74 | 7 | 415 | 589 | 70 | 243 | |
| | | | | | at 1.2° C./s | 1/2t | L | F + P | 75 | 6.5 | 398 | 572 | 70 | 237 | |
| | | | | | from 940 to | 1/2t | C | | | | 397 | 575 | 69 | 203 | |
| | | | | | 600° C. | 1/2t | Z | | | | 382 | 543 | 70 | 104 | |
| E-1 | E | 6–10 | 35 | 100 | Air cooling | Surface | L | F + P | 84 | 6.5 | 435 | 611 | 71 | 278 | |
| | | | | | | 1/2t | L | F + P | 86 | 6 | 422 | 607 | 70 | 272 | |
| | | | | | | 1/2t | C | | | | 425 | 605 | 70 | 255 | |
| | | | | | | 1/2t | Z | | | | 415 | 591 | 70 | 128 | |
| F-1 | F | 6–9 | 30 | 100 | Air cooling | Surface | L | F + P | 78 | 7 | 411 | 580 | 71 | 303 | |
| | | | | | | 1/2t | L | F + P | 80 | 6.5 | 391 | 563 | 69 | 287 | |
| | | | | | | 1/2t | C | | | | 393 | 565 | 70 | 259 | |
| | | | | | | 1/2t | Z | | | | 375 | 537 | 70 | 137 | |
| G-1 | G | 5–9 | 30 | 100 | Air cooling | Surface | L | F + P | 76 | 7.5 | 441 | 617 | 71 | 262 | |
| | | | | | | 1/2t | L | F + P | 78 | 7 | 435 | 609 | 71 | 248 | |
| | | | | | | 1/2t | C | | | | 431 | 604 | 71 | 235 | |
| | | | | | | 1/2t | Z | | | | 423 | 601 | 70 | 116 | |
| H-1 | H | 5–9 | 30 | 80 | Air cooling | Surface | L | F + P | 79 | 7.5 | 407 | 579 | 70 | 300 | |
| | | | | | | 1/2t | L | F + P | 80 | 7 | 386 | 557 | 69 | 284 | |
| | | | | | | 1/2t | C | | | | 382 | 551 | 69 | 268 | |
| | | | | | | 1/2t | Z | | | | 368 | 532 | 69 | 114 | |

*Microstructure: F: ferrite; P: pearlite; B: bainite

TABLE 4

| No. | Steel | Draft/pass (%) | Cumulative draft 1100–950° C. (%) | Flange thickness (mm) | Cooling after rolling | Site | Direction | Micro-structure* | Ferrite area ratio (%) | Grain size No. | YS (MPa) | TS (MPa) | YR (%) | vEo (J) | |
|---|---|---|---|---|---|---|---|---|---|---|---|---|---|---|---|
| I-1 | I | 5–8 | 25 | 80 | Air cooling | Surface | L | F + P | 74 | 7 | 415 | 582 | 71 | 292 | Examples of the Invention |
| | | | | | | 1/2t | L | F + P | 76 | 6.5 | 393 | 560 | 70 | 266 | |
| | | | | | | 1/2t | C | | | | 388 | 557 | 70 | 243 | |
| | | | | | | 1/2t | Z | | | | 374 | 537 | 70 | 112 | |
| J-1 | J | 6–9 | 20 | 80 | Air cooling | Surface | L | F + P | 74 | 7 | 415 | 582 | 71 | 292 | |
| | | | | | | 1/2t | L | F + P | 76 | 6.5 | 393 | 560 | 70 | 266 | |
| | | | | | | 1/2t | C | | | | 388 | 557 | 70 | 243 | |
| | | | | | | 1/2t | Z | | | | 374 | 537 | 70 | 112 | |
| K-1 | K | 6–9 | 30 | 80 | Air cooling | Surface | L | F + P | 78 | 7 | 429 | 589 | 73 | 29830 | |
| | | | | | | 1/2t | L | F + P | 79 | 6.5 | 411 | 581 | 71 | 0 | |
| | | | | | | 1/2t | C | | | | 419 | 578 | 72 | 235 | |
| | | | | | | 1/2t | Z | | | | 406 | 558 | 73 | 138 | |
| L-1 | L | 6–9 | 25 | 80 | Air cooling | Surface | L | F + P | 73 | 6 | 501 | 606 | 83 | 224 | Comparative Examples |
| | | | | | | 1/2t | L | F + P | 75 | 5.5 | 480 | 593 | 81 | 212 | |
| | | | | | | 1/2t | C | | | | 471 | 585 | 81 | 108 | |
| | | | | | | 1/2t | Z | | | | 453 | 562 | 81 | 54 | |
| M-1 | M | 5–10 | 30 | 80 | Air cooling | Surface | L | F + P | 84 | 6 | 503 | 615 | 82 | 118 | |
| | | | | | | 1/2t | L | F + P | 85 | 5.5 | 487 | 608 | 80 | 105 | |
| | | | | | | 1/2t | C | | | | 485 | 600 | 81 | 88 | |
| | | | | | | 1/2t | Z | | | | 476 | 599 | 79 | 72 | |
| N-1 | N | 5–9 | 30 | 80 | Air cooling | Surface | L | F + P | 77 | 6.5 | 371 | 495 | 75 | 252 | |
| | | | | | | 1/2t | L | F + P | 78 | 6 | 358 | 489 | 73 | 242 | |
| | | | | | | 1/2t | C | | | | 355 | 483 | 73 | 148 | |
| | | | | | | 1/2t | Z | | | | 350 | 477 | 73 | 73 | |
| O-1 | O | 5–9 | 30 | 80 | Air cooling | Surface | L | F + P | 79 | 6 | 325 | 482 | 67 | 253 | |
| | | | | | | 1/2t | L | F + P | 81 | 5.5 | 322 | 480 | 67 | 247 | |
| | | | | | | 1/2t | C | | | | 324 | 482 | 67 | 184 | |
| | | | | | | 1/2t | Z | | | | 318 | 473 | 67 | 92 | |

*Microstructure: F: ferrite; P: pearlite; B: bainite

TABLE 5

| No. | Steel | Draft/pass (%) | Cumulative draft 1100–950° C. (%) | Flange thickness (mm) | Cooling after rolling | Site | Direction | Micro-structure* | Ferrite area ratio (%) | Grain size No. | YS (MPa) | TS (MPa) | YR (%) | $vE_o$ (J) | |
|---|---|---|---|---|---|---|---|---|---|---|---|---|---|---|---|
| P-1 | P | 5–9 | 30 | 80 | Air cooling | Surface | L | F + P | 79 | 6 | 412 | 565 | 73 | 237 | Comparative Examples |
| | | | | | | 1/2t | L | F + P | 81 | 5.5 | 404 | 554 | 73 | 221 | |
| | | | | | | 1/2t | C | | | | 399 | 553 | 72 | 99 | |
| | | | | | | 1/2t | Z | | | | 393 | 543 | 72 | 46 | |
| Q-1 | Q | 5–9 | 30 | 80 | Air cooling | Surface | L | F + P | 80 | 6.5 | 372 | 535 | 70 | 248 | |
| | | | | | | 1/2t | L | F + P | 81 | 6 | 374 | 524 | 71 | 244 | |
| | | | | | | 1/2t | C | | | | 369 | 523 | 71 | 138 | |
| | | | | | | 1/2t | Z | | | | 363 | 513 | 71 | 57 | |
| R-1 | R | 5–9 | 30 | 80 | Air cooling | Surface | L | F + P | 81 | 6 | 345 | 505 | 68 | 162 | |
| | | | | | | 1/2t | L | F + P | 83 | 5.5 | 327 | 485 | 67 | 166 | |
| | | | | | | 1/2t | C | | | | 323 | 480 | 67 | 89 | |
| | | | | | | 1/2t | Z | | | | 319 | 476 | 67 | 43 | |
| S-1 | S | 5–9 | 30 | 80 | Air cooling | Surface | L | F + P | 83 | 6 | 352 | 520 | 68 | 240 | |
| | | | | | | 1/2t | L | F + P | 85 | 5.5 | 350 | 519 | 67 | 235 | |
| | | | | | | 1/2t | C | | | | 348 | 521 | 67 | 100 | |
| | | | | | | 1/2t | Z | | | | 340 | 512 | 66 | 56 | |
| T-1 | T | 5–9 | 30 | 80 | Air cooling | Surface | L | F + P | 83 | 6 | 329 | 492 | 67 | 182 | |
| | | | | | | 1/2t | L | F + P | 84 | 5.5 | 323 | 490 | 66 | 162 | |
| | | | | | | 1/2t | C | | | | 325 | 488 | 67 | 94 | |
| | | | | | | 1/2t | Z | | | | 321 | 482 | 67 | 50 | |
| U-1 | U | 5–9 | 30 | 80 | Air cooling | Surface | L | F + P | 83 | 6 | 376 | 540 | 70 | 205 | |
| | | | | | | 1/2t | L | F + P | 85 | 5.5 | 369 | 535 | 69 | 207 | |
| | | | | | | 1/2t | C | | | | 366 | 534 | 69 | 82 | |
| | | | | | | 1/2t | Z | | | | 355 | 525 | 68 | 44 | |
| V-1 | V | 6–10 | 30 | 80 | Air cooling | Surface | L | F + P + B | 78 | 7 | 427 | 609 | 70 | 202 | |
| | | | | | | 1/2t | L | F + P | 79 | 6.5 | 407 | 594 | 68 | 185 | |
| | | | | | | 1/2t | C | | | | 408 | 596 | 68 | 102 | |
| | | | | | | 1/2t | Z | | | | 401 | 592 | 68 | 51 | |

*Microstructure: F: ferrite; P: pearlite; B: bainite dispersion in strength in the thickness direction, excellent impact toughness at the flange thickness center and weldability, so far difficult to manufacture. The steel is suitable for use in structural members such as pillars, beams and the like for building structures.

This invention has been described in connection with preferred embodiments. However, it should be understood that there is no intent to limit this invention to the embodiments described above. On the contrary, the intent is to cover all alternatives, modifications, and equivalents as may be included within the spirit and scope of the invention. Thus, it should be appreciated that various other modifications and changes may occur to those skilled in the art without departing from the spirit and scope of this invention.

What is claimed is:

1. A heavy-wall H-shaped steel excellent in strength, toughness and earthquake resistance, comprising:

C: from about 0.05 to about 0.18 wt %,

Si: up to about 0.60 wt %,

Mn: from about 1.00 wt % to about 1.80 wt %,

P: up to about 0.020 wt %,

S: less than 0.004 wt %,

Al: from 0.016 wt % to 0.050 wt %,

V: from 0.04 wt % to 0.15 wt %,

N: from 0.0070 wt % to 0.0200 wt %;

one or two elements selected from the group consisting of:

Cu: from about 0.02 wt % to about 0.60 wt %,

Ni: from about 0.02 wt % to about 0.60 wt %,

Cr: from about 0.02 wt % to about 0.50 wt %, and

Mo: from about 0.01 wt % to about 0.20 wt %, and the balance being Fe and incidental impurities, where the V content and the N content are within ranges satisfying the following formula (1);

a Ti content is within a range satisfying the following formula (2); and the carbon equivalent (Ceq) is defined by the following formula (3) and is within a range of from about 0.36 wt % to about 0.45 wt %:

$$(V \times N)/S \geq 0.150 \quad (1)$$

$$0.002 \leq Ti \leq 1.38 \times N - 8.59 \times 10^{-4} \quad (2)$$

$$Ceq = C + Si/24 + Mn/6 + Ni/40 + Cr/5 + Mo/4 + V/14 \quad (3)$$

wherein, the Charpy absorbed energy at a temperature of 0° C. in L, C and Z-directions at the flange thickness center is at least about 100 J; and the yield strength is at least about 325 MPa.

2. A heavy-wall H-shaped steel according to claim 1, comprising a microstructure including ferrite+pearlite or ferrite+pearlite+bainite, wherein the ferrite grain size as determined by JIS G0552 is at least No. 6, and the area ratio of ferrite is from at least about 50% to about 90%.

3. A heavy-wall H-shaped steel according to claim 1, further comprising at least one of from about 0.0010 wt % to about 0.0200 wt % REM and from about 0.0005 wt % to about 0.0100 wt % Ca.

4. A heavy-wall H-shaped steel according to claim 1, further comprising from about 0.0001 wt % to about 0.0020 wt % B.

5. A heavy-wall H-shaped steel according to claim 1, further comprising at least one of from about 0.0010 wt % to about 0.0200 wt % REM and from about 0.0005 wt % to about 0.0100 wt % Ca, and from about 0.0001 wt % to 0.0020 wt % B.

6. A heavy-wall H-shaped steel according to claim 1, being characterized as having a yield ratio of less than about 80%.

7. A heavy-wall H-shaped steel according to claim 1, further comprising:

C: from about 0.08 wt % to about 0.18 wt %,

Si: from about 0.10 wt % to about 0.60 wt %,

Mn: from about 1.20 wt % to about 1.70 wt %,

P: less than about 0.020 wt %,

S: less than or equal to 0.001 wt %,

Al: from 0.016 wt % to 0.050 wt %,

V:from 0.05 wt % to 0.12 wt %,

N :from 0.0070 wt % to 0.0160 wt %;

one or two elements selected from the group consisting of:

Cu: from at least about 0.02 wt % to about 0.60 wt %,

Ni: from at least about 0.02 wt % to about 0.60 wt %,

Cr: from at least about 0.02 wt % to about 0.50 wt %,

Mo: from at least about 0.01 wt % to about 0.20 wt %, and the balance being Fe and incidental impurities.

8. A beam comprising a heavy-wall H-shaped steel according to claim 1.

9. A pillar comprising a heavy-wall H-shaped steel according to claim 1.

10. A heavy-wall H-shaped steel characterized as having a Charpy absorbed energy at 0° C. in L, C and Z-directions at a flange thickness center of at least about 100 J, and having a yield strength of at least about 325 Mpa.

11. A heavy-wall H-shaped steel according to claim 10, being further characterized as having a yield ratio of less than about 80%.

12. A heavy-wall H-shaped steel according to claim 10, comprising a microstructure including ferrite+pearlite or ferrite+pearlite+bainite, wherein the ferrite grain size as determined by JIS G0552 is at least No. 6 and the area ratio of ferrite is from at least about 50% to about 90%.

13. A beam comprising a heavy-wall H-shaped steel according to claim 10.

14. A pillar comprising a heavy-wall H-shaped steel according to claim 10.

15. A process for making a heavy-wall H-shaped steel excellent in strength, toughness and earthquake resistance, comprising:

heating a steel bloom comprising:

C: from about 0.05 wt % to about 0.18 wt %,

Si: up to about 0.60 wt %,

Mn: from about 1.00 wt % to about 1.80 wt %,

P: up to about 0.020 wt %,

S: less than 0.004 wt %,

Al: from 0.016 wt % to 0.050 wt %,

V:from 0.04wt %to 0.15wt %,

N: from 0.0070 wt % to 0.0200 wt %;

one or two elements selected from the group consisting of:

Cu: from about 0.02 wt % to about 0.60 wt %,

Ni: from about 0.02 wt % to about 0.60 wt %,

Cr: from about 0.02 wt % to about 0.50 wt %,

Mo: from about 0.01 wt % to about 0.20 wt %, and the balance being Fe and incidental impurities;

where the V content and the N content are within ranges satisfying the following formula (1);

a Ti content is within a range satisfying the following formula (2); and the carbon equivalent (Ceq) as defined by the following formula (3) is within a range of from about 0.36 wt % to about 0.45 wt %:

$$(V \times N)/S \geq 0.150 \quad (1)$$

$$0.002 \leq Ti \leq 1.38 \times N - 8.59 \times 10^{-4} \quad (2)$$

$$Ceq = C + Si/24 + Mn/6 + Ni/40 + Cr/5 + Mo/4 + V/14; \quad (3)$$

heating the bloom;

rolling the bloom; and cooling the rolled bloom to produce the heavy-wall H-shaped steel;

wherein the heavy-wall H-shaped steel is characterized as having a Charpy absorbed energy at 0° C. in L, C and Z-directions at a flange thickness center of at least 100 J, and a yield strength of at least about 325 Mpa.

16. A process for making a heavy-wall H-shaped steel according to claim 15, wherein:

the heating comprises heating the bloom to a temperature of from about 1,050° C. to about 1,350° C.;

the rolling comprises rolling the bloom at a temperature of from about 1,1 00° C. to about 950° C., a reduction per pass of from about 5% to about 10% and a total reduction of at least about 20%; and the cooling comprises cooling the rolled bloom by air-cooling to room temperature, or slow cooling—high temperature stoppage of cooling followed by air-cooling to room temperature.

17. A process for making a heavy-wall H-shaped steel according to claim 15, wherein the heavy-wall H-shaped steel comprises a microstructure including ferrite+pearlite or ferrite+pearlite+bainite, wherein the ferrite grain size as determined by JIS G0552 is at least No. 6, and the area ratio of ferrite is from at least about 50% to about 90%.

18. A process for making a heavy-wall H-shaped steel according to claim 15, wherein the bloom further comprises at least one of from about 0.0010 wt % to about 0.0200 wt % REM and from about 0.0005 wt % to about 0.0100 wt % Ca.

19. A process for making a heavy-wall H-shaped steel according to claim 15, wherein the bloom further comprises from about 0.0001 wt % to about 0.0020 wt % B.

20. A process for making a heavy-wall H-shaped steel according to claim 15, wherein the bloom further comprises at least one of from about 0.0010 wt % to about 0.0200 wt % REM and from about 0.0005vwt % to about 0.0100 wt % Ca, and from about 0.0001 wt % to about 0.0020 wt % B.

* * * * *